US005911516A

United States Patent [19]

Chang

[11] Patent Number: 5,911,516

[45] Date of Patent: Jun. 15, 1999

[54] BIDET ATTACHMENT FOR TOILET BOWLS

[76] Inventor: Wan-Lai Chang, 3F, No. 446-1, Fu-Chin St., Taipei City, Taiwan

[21] Appl. No.: 09/026,984

[22] Filed: Feb. 20, 1998

[30] Foreign Application Priority Data

Aug. 9, 1997 [TW] Taiwan ..... 86213541

[51] Int. Cl.[6] ..... E03D 9/08

[52] U.S. Cl. ..... 4/420.2; 4/447

[58] Field of Search ..... 4/420.2, 420.4, 4/447, 448

[56] References Cited

U.S. PATENT DOCUMENTS

| | | | |
|---|---|---|---|
| 1,752,782 | 4/1930 | Burton | 4/448 |
| 3,430,267 | 3/1969 | Van Houten | 4/420.1 |
| 3,513,487 | 5/1970 | Palermo et al. | 4/420.4 |
| 4,926,509 | 5/1990 | Bass | 4/448 |
| 5,210,885 | 5/1993 | Ruo | 4/420.2 |
| 5,384,919 | 1/1995 | Smith | 4/448 |
| 5,572,748 | 11/1996 | Nee | 4/420.2 |
| 5,659,901 | 8/1997 | Derakhshan | 4/420.1 |

FOREIGN PATENT DOCUMENTS

| | | | |
|---|---|---|---|
| 2054298 | 4/1993 | Canada | 4/420.2 |

*Primary Examiner*—Robert M. Fetsuga
*Attorney, Agent, or Firm*—Merchant, Gould, Smith, Edell, Welter & Schmidt

[57] ABSTRACT

The bidet housing of a bidet attachment includes a base plate for mounting on the upper horizontal rim surface of a toilet bowl, and a top cover mounted on the base plate. The bidet housing confines an opening for access into the toilet bowl. A heating element inside the bidet housing extends around a major part of the opening. A flexible water tube is sheathed on the heating element, and confines a water passage therewith. A water supply valve supplies water to the water passage. Water from the water passage is supplied to a nozzle assembly that is movable between retracted and extended positions. The heating element can be actuated for warming up the bidet housing and for heating water that flows through the water passage from the water supply valve and that flows out of the nozzle assembly.

6 Claims, 4 Drawing Sheets

BIDET ATTACHMENT FOR TOILET BOWLS

BACKGROUND OF THE INVENTION

1. Field of the Invention

The invention relates to a bidet attachment for toilet bowls, more particularly to one that incorporates a heating element for seat warming and water heating purposes.

2. Description of the Related Art

Bidet attachments for toilet bowls are known in the art, and generally include a bidet housing that is mounted on an upper horizontal rim surface of the toilet bowl, and a nozzle assembly that is disposed on the bottom side of the bidet housing. The nozzle assembly is movable between a retracted position, where the nozzle assembly is adjacent to the upper horizontal rim surface of the toilet bowl, and an extended position, where the nozzle assembly extends into the toilet bowl. In the extended position, the nozzle assembly is capable of directing a stream of cleansing water against the underside of the user who is seated on the bidet housing, thereby cleansing the genital and anal skin areas on the underside of the user.

Usually, the nozzle assembly of a known bidet attachment is connected to a source of heated water. The known bidet attachment also includes a heating device in the form of heating strips inside the bidet housing to warm the latter and make the bidet attachment more comfortable to use by the person seated thereon.

It is noted that the heating device of the aforesaid known bidet attachment is used solely for warming of the bidet housing. The supply of heated water to the nozzle assembly is generally achieved with the use of a mixing water valve that is connected to hot and cold water supply lines, or with the use of a water heating device to heat water from a cold water supply line, thereby resulting in a relatively complicated construction.

SUMMARY OF THE INVENTION

Therefore, the main object of the present invention is to provide a bidet attachment that can be installed on a toilet bowl and that incorporates a heating element for seat warming and water heating purposes.

Another object of the present invention is to provide a bidet attachment that permits automatic control of the water supplying, seat warming and water heating operations.

Accordingly, the bidet attachment of this invention is adapted for use with a toilet bowl having an upper horizontal rim surface, and includes a looped bidet housing, a curved heating element, a flexible water tube, a water supply valve, hollow first and second water coupling units, and a nozzle assembly.

The bidet housing includes a base plate adapted to be mounted on the upper horizontal rim surface of the toilet bowl, and a top cover mounted on the base plate and adapted for seating of a person thereon. The bidet housing confines an opening for access into the toilet bowl.

The heating element is disposed inside the bidet housing on top of the base plate, and extends around a major part of the opening. The heating element has two terminating end portions.

The flexible water tube is sheathed on the heating element, and confines a water passage therewith.

The water supply valve is mounted on the bidet housing, and has an input side adapted to be connected to an external water supply line, and an output side with a water inlet pipe connected thereto. The water supply valve permits water flow from the input side to the output side when actuated.

Each of the first and second water coupling units is mounted on the base plate, and has a water port and a coupling port. The water port of the first water coupling unit is connected to the water inlet pipe. The terminating end portions of the heating element extend respectively into the first and second water coupling units via the coupling ports of the latter. The flexible water tube has opposite ends secured respectively on the coupling ports of the first and second water coupling units. The coupling ports are wider than the cross-sectional size of the heating element so that water entering into the first water coupling unit can flow into the water passage, and so that water exiting the water passage can flow into the second water coupling unit.

The nozzle assembly includes a water outlet pipe disposed in the bidet housing and connected to the water port of the second water coupling unit, and a spray pipe disposed below the base plate. The spray pipe has an inlet end that extends into the bidet housing and that is coupled to the water outlet pipe such that the spray pipe is rotatable relative to the water outlet pipe about a horizontal axis between a retracted position, where the spray pipe is disposed adjacent to the base plate, and an extended position, where the spray pipe is adapted to extend into the toilet bowl. The spray pipe further has an outlet end that is provided with a spray nozzle.

The heating element can be actuated for warming up the bidet housing and for heating water that flows through the water passage from the water supply valve and that flows out of the nozzle assembly.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
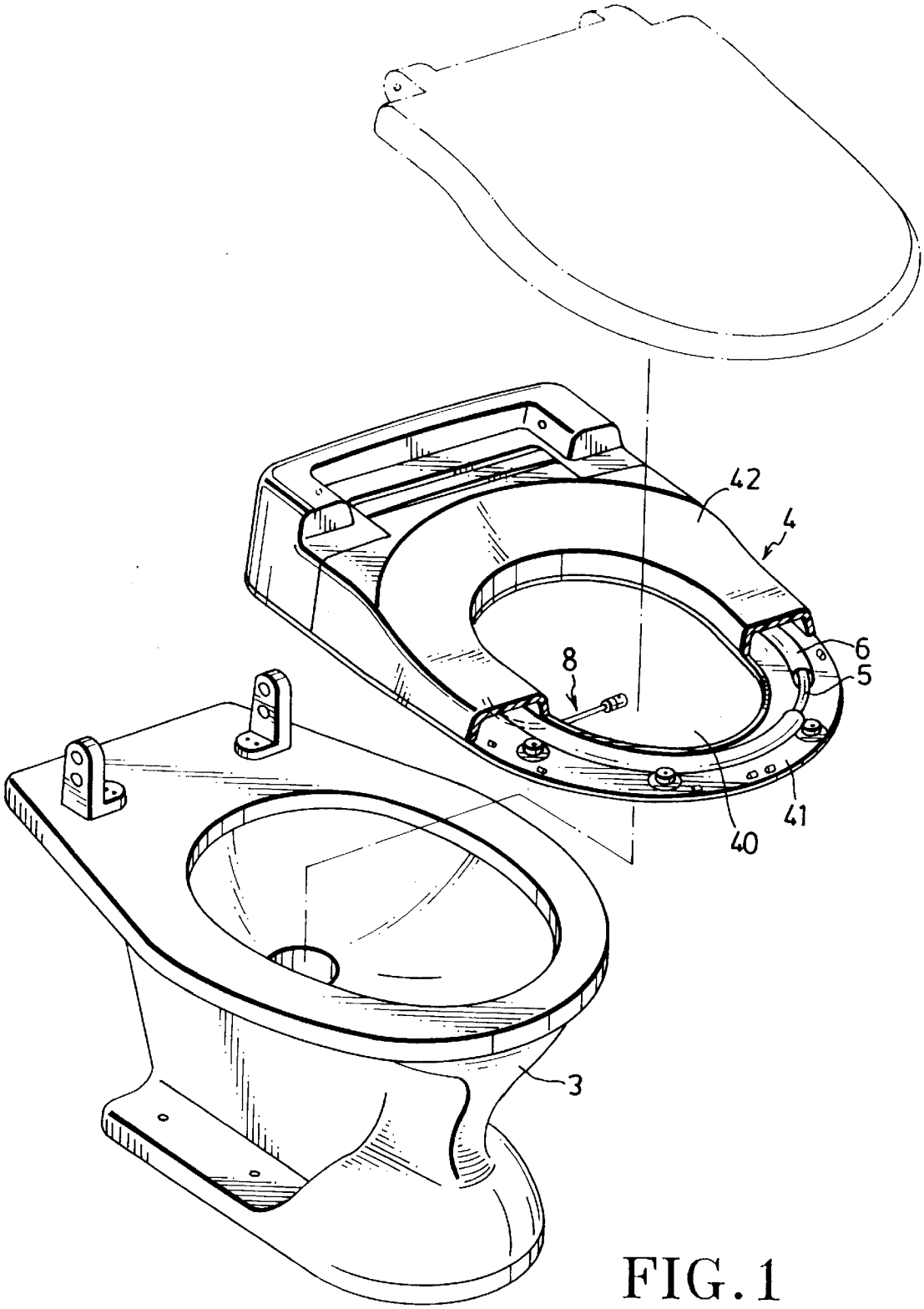
FIG. 1 is a perspective view illustrating a conventional toilet bowl and the preferred embodiment of a bidet attachment for the toilet bowl in accordance with this invention.

Referring to FIG. 1, the preferred embodiment of a bidet attachment according to the present invention is shown to comprise a looped bidet housing 4 that is adapted to be installed on an upper horizontal rim surface of a toilet bowl 3, such as with the use of bolts (not shown). The bidet housing 4 confines an opening 40 for access into the toilet bowl 3, and includes a base plate 41 to be mounted on the upper horizontal rim surface of the toilet bowl 3, and a top cover 42 mounted on the base plate 41 and adapted for seating of a person thereon.

Figure 2:
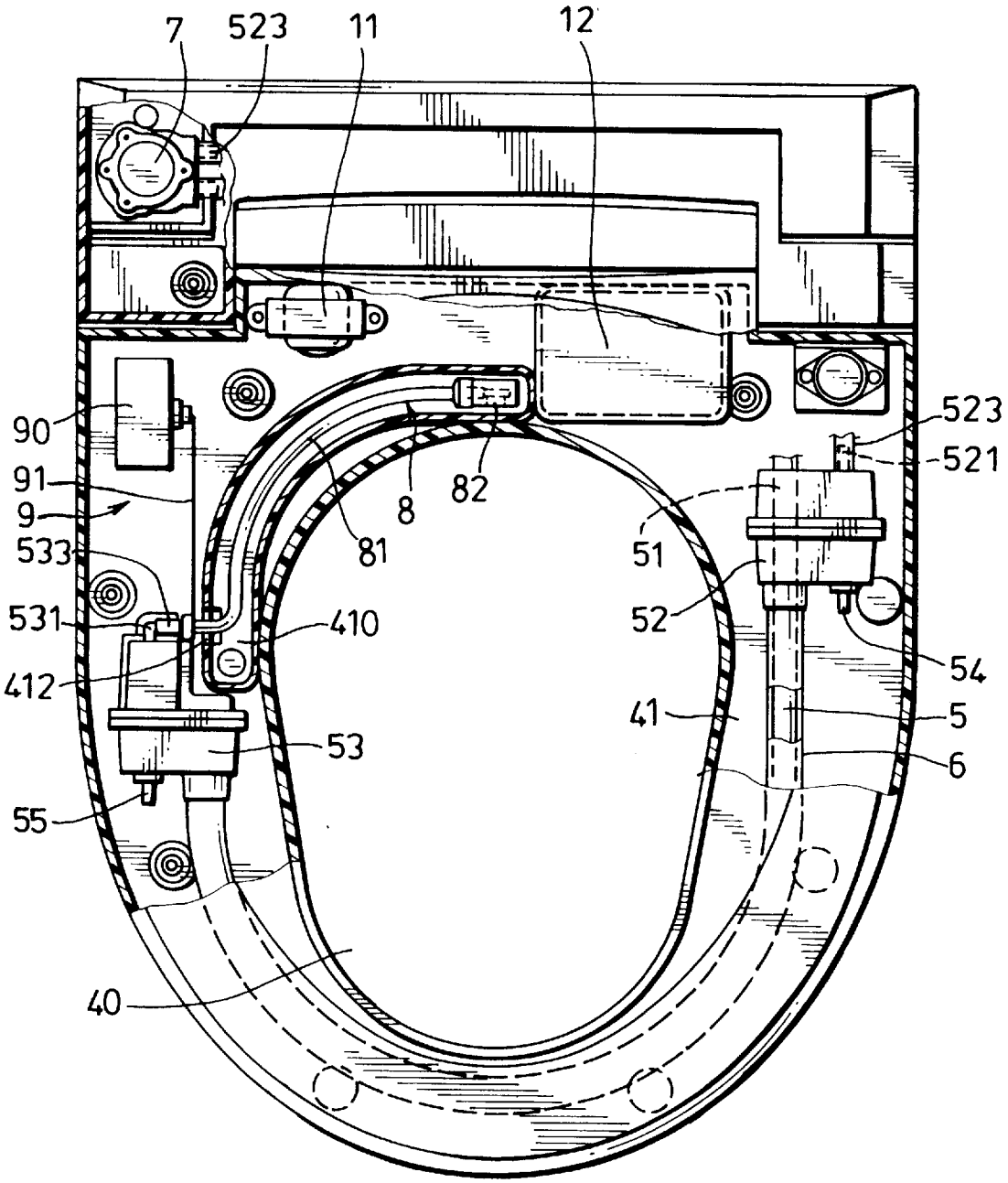
FIG. 2 is a schematic top view of the preferred embodiment, a top cover of the bidet housing being removed for the sake of clarity.

Referring to FIGS. 1 and 2, the base plate 41 has a bottom side formed with a pipe recess 410, and an access hole 412 for access into the pipe recess 410. A curved heating element 5 is disposed inside the bidet housing 4 on top of the base plate 41, and extends around a major part of the opening 40. The heating element 5 has two terminating end portions 51 mounted on the base plate 41 by means of hollow first and second water coupling units 52, 53, respectively.

As shown in FIG. 2, a water supply valve 7 is mounted on the base plate 41 inside the bidet housing 4, and has an input side connected to an external cold water supply line (not shown), and an output side with a water inlet pipe 523 connected thereto. The supply valve 7 can be actuated electrically to permit the flow of cold water to the water inlet pipe 523.

Figure 3A:
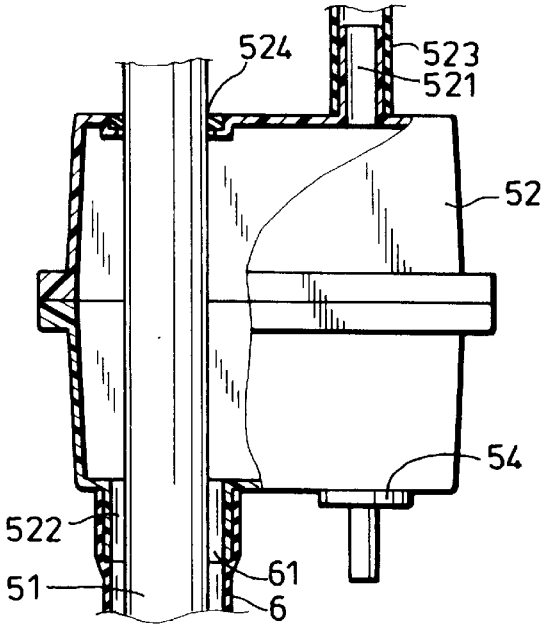
FIG. 3*a* is a partly sectional, magnified schematic view illustrating how a heating element of the preferred embodiment is able to heat cold water from a water supply valve.
Figure 3B:
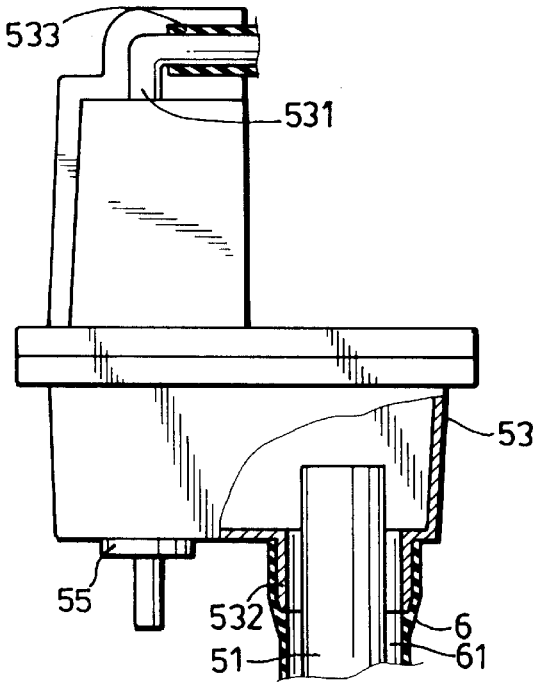
FIG. 3*b* is a partly sectional, magnified schematic view illustrating how water heated by the heating element is supplied to a nozzle assembly of the preferred embodiment.

Referring to FIGS. 2, 3*a* and 3*b*, a flexible water tube 6 is sheathed on the heating element 5, and confines a water passage 61 therewith. The first water coupling unit 52 is in the form of a hollow box, and has a tubular water port 521 and a tubular coupling port 522. The tubular water port 521 is connected to the water inlet pipe 523. One of the terminating end portions 51 of the heating element 5 extends into the first water coupling unit 52 via the tubular coupling port 522, and extends fittingly and sealingly through the first water coupling unit 52 via a hole 524 in the latter. One end of the flexible water tube 6 is sleeved fittingly and sealingly on the tubular coupling port 522. The tubular coupling port 522 is wider than the cross-sectional size of the heating element 5 so that water entering into the first water coupling unit 52 via the tubular water port 521 can flow into the water passage 61 via the tubular coupling port 522. The first water coupling unit 52 further has an inlet temperature sensor 54 mounted thereon to detect the water temperature therein.

The second water coupling unit 53 is also in the form of a hollow box, and has a tubular water port 531 and a tubular coupling port 532. The other terminating end portion 51 of the heating element 5 extends into the second water coupling unit 53 via the tubular coupling port 532. The other end of the flexible water tube 6 is sleeved fittingly and sealingly on the tubular coupling port 532. As with the tubular coupling port 522, the tubular coupling port 532 is wider than the cross-sectional size of the heating element 5 so that water exiting the water passage 61 can flow into the second water coupling unit 53 via the tubular coupling port 532. The second water coupling unit 53 further has an outlet temperature sensor 55 mounted thereon to detect the water temperature therein.

A nozzle assembly 8 includes a water outlet pipe 533 disposed in the bidet housing 4 and connected to the tubular water port 531 of the second water coupling unit 53, and a curved spray pipe 81 disposed below the base plate 41. The spray pipe 81 has an inlet end that extends into the bidet housing 4 via the access hole 412 in the base plate 41 and that is coupled to the water outlet pipe 533 such that the spray pipe 81 is rotatable relative to the water outlet pipe 533 about a horizontal axis in a conventional manner. The spray pipe 81 further has an outlet end provided with a spray nozzle 82. The nozzle assembly 8 is movable between a retracted position, where the spray pipe 81 is received in the pipe recess 410 and is adjacent to the upper horizontal rim surface of the toilet bowl 3, as shown in FIG. 2, and an extended position generally transverse to the retracted position, where the spray pipe 81 extends away from the bottom side of the base plate 40 so as to extend into the toilet bowl 3, as shown in FIG. 1. In the extended position, the nozzle assembly 8 is capable of directing a stream of cleansing water, via the spray nozzle 82, against the underside of the user who is seated on the top cover 42, thereby cleansing the genital and anal skin areas on the underside of the user as is known in the art.

In the preferred embodiment, there are two extended positions, e.g. forward extended and rearward extended, for the nozzle assembly 8. In the forward extended position, the stream of cleansing water from the nozzle assembly 8 can be used to clean the vaginal skin area of a female user, whereas in the rearward extended position, the stream of cleansing water from the nozzle assembly 8 can be used to clean the anal skin area of the user.

A drive unit 9 includes a motor 90 mounted on the base plate 40, and a transmission unit 91 for coupling the motor 90 with the inlet end of the spray pipe 81 to permit automated movement of the nozzle assembly 8 between the retracted and extended positions. In this embodiment, the transmission unit 91 is a known crank mechanism capable of transmitting rotation of one component to another component. Since the feature of the present invention does not reside in the specific configuration of the known transmission unit 91, a detailed description of the same will be omitted herein.

Figure 4:
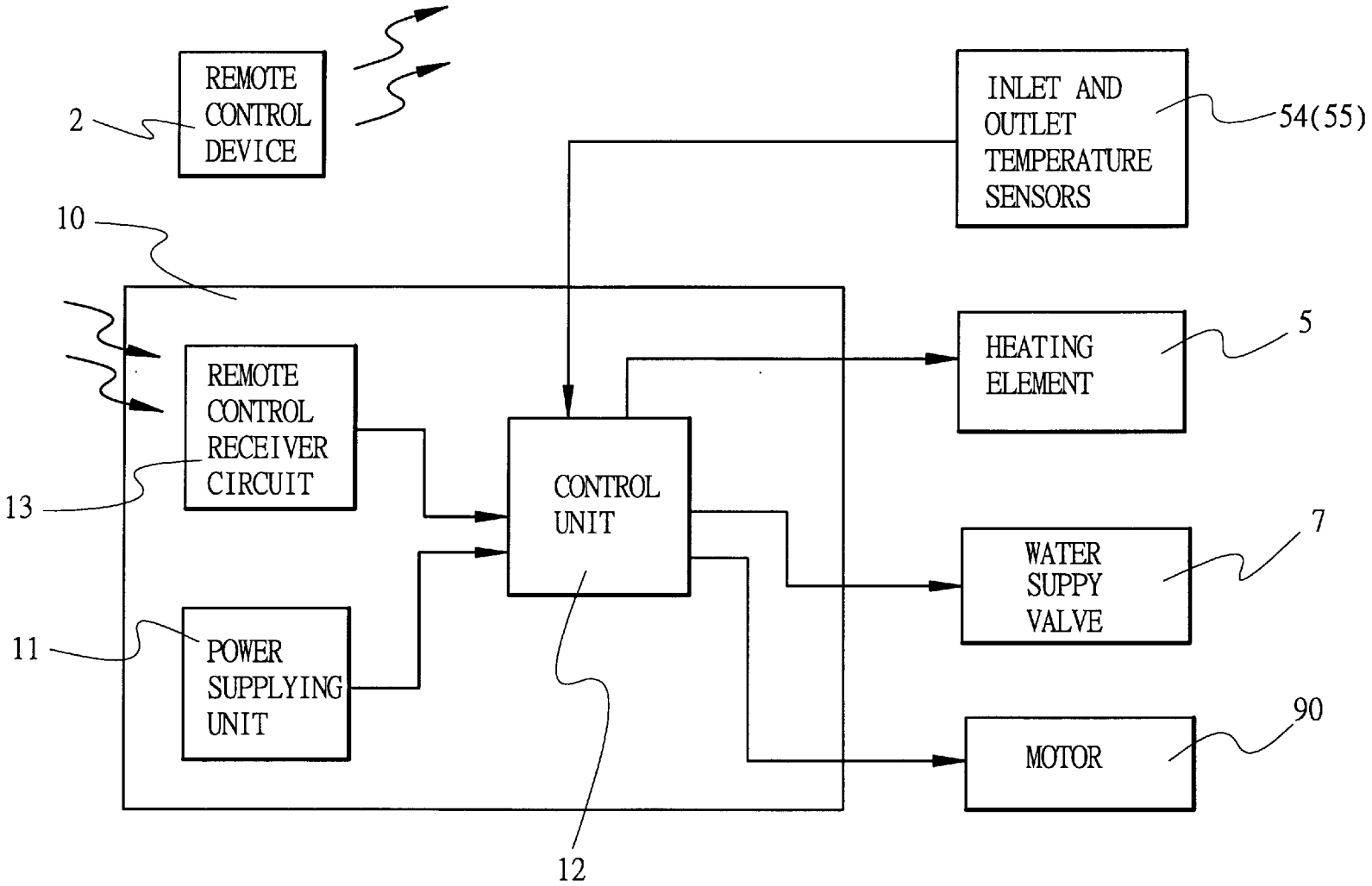
FIG. 4 his a schematic circuit block diagram of the preferred embodiment.

Referring to FIGS. 2 and 4, a controller 10 is mounted on the base plate 40, and includes a power supplying unit 11 and a processor-based control unit 12. As shown in FIG. 4, the control unit 12 is connected to the power supplying unit 11, the heating element 5, the water supply valve 7, the inlet and outlet temperature sensors 54, 55, and the motor 90, and is operable to actuate the heating element 5, the water supply valve 7 and the motor 90. The controller 10 further includes a remote control receiver circuit 13 connected to the control unit 12. The bidet attachment further includes a portable remote control device 2 for remote control operation of the control unit 12. By operating the remote control device 2, the water spraying operation, the seat warming operation, the nozzle position, and the water temperature can be controlled as desired.

In use, the user operates the remote control device 2 to inform the control unit 12 of the selected extended position, e.g. forward extended or rearward extended, for the nozzle assembly 8. Initially, the control unit 12 actuates the water supply valve 7 so that water can flow through the water passage 61. The control unit 12 then actuates the heating element 5 to heat the water flowing through the water passage 61. Upon detecting the temperature of the water flowing through the first and second water coupling units 52, 53, the control unit 12 calculates the required electrical power for the heating element 5 to attain the desired water temperature at the nozzle assembly 8, the desired water temperature being preset beforehand with the use of the remote control device 2. The control unit 12 disables the water supply valve 7, and adjusts the electrical power to the heating element 5 to the calculated level. After actuating the motor 90 to move the nozzle assembly 8 to the selected extended position, the control unit 12 actuates the water supply valve 7 so that a stream of cleansing water can be directed against the underside of the user who is seated on the top cover 42 for cleansing purposes. At this time, the control unit 12 monitors the water temperature at the first and second water coupling units 52, 53 continuously so that the electrical power supplied to the heating element 5 can be adjusted continuously to maintain the desired water temperature at the nozzle assembly 8.

When the remote control device 2 is operated to terminate the cleansing operation, the control unit 12 disables the water supply valve 7, and actuates the motor 90 to move the nozzle assembly 8 back to the retracted position. Once the nozzle assembly 8 has been retracted, the water supply valve 7 is preferably operated for a short period of time to rinse the rim of the toilet bowl 3.

By operating the remote control device 2, the user can set the control unit 12 to operate in a seat warming mode, where electrical power is supplied continuously to the heating element 5 to maintain the top cover 42 at a desired warm temperature, such as from 34 to 36 degrees Celsius.

It has thus been shown that the heating element 5 of the bidet attachment of this invention can be actuated for warming up the bidet housing 4 and for heating the water that flows through the water passage 61 from the water supply valve 7 and that flows out of the nozzle assembly 8. In addition, the remote control device 2 facilitates automatic control of the water supplying, seat warming and water heating operations. The objects of the present invention are thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A bidet attachment for a toilet bowl with an upper horizontal rim surface, comprising:

a looped bidet housing including a base plate adapted to be mounted on the upper horizontal rim surface of the toilet bowl, and a top cover mounted on said base plate and adapted for seating of a person thereon, said bidet housing confining an opening for access into the toilet bowl;

a curved heating element disposed inside said bidet housing on top of said base plate and extending around a major part of said opening, said heating element having two terminating end portions;

a flexible water tube sheathed on said heating element and confining a water passage therewith;

a water supply valve mounted on said bidet housing and having an input side adapted to be connected to an external water supply line, and an output side with a water inlet pipe connected thereto, said water supply valve permitting water flow from said input side to said output side when actuated;

hollow first and second water coupling units mounted on said base plate, each of which has a water port and a coupling port, said water port of said first water coupling unit being connected to said water inlet pipe, said terminating end portions of said heating element extending respectively into said first and second water coupling units via said coupling ports of said first and second water coupling units, said flexible water tube having opposite ends secured respectively on said coupling ports of said first and second water coupling units, said coupling ports being wider than crosssectional size of said heating element so that water entering into said first water coupling unit can flow into said water passage and so that water exiting said water passage can flow into said second water coupling unit; and a nozzle assembly including a water outlet pipe disposed in said bidet housing and connected to said water port of said second water coupling unit, and a spray pipe disposed below said base plate, said spray pipe having an inlet end that extends into said bidet housing and that is coupled to said water outlet pipe such that said spray pipe is rotatable relative to said water outlet pipe about a horizontal axis between a retracted position, where said spray pipe is disposed adjacent to said base plate, and an extended position, where said spray pipe is adapted to extend into the toilet bowl, said spray pipe further having an outlet end that is provided with a spray nozzle;

said heating element being actuatable for warming up said bidet housing and for heating water that flows through said water passage from said water supply valve and that flows out of said nozzle assembly.

2. The bidet attachment as claimed in claim 1, wherein said base plate has a bottom side formed with a pipe recess for receiving said spray pipe of said nozzle assembly therein when said spray pipe is in the retracted position, said base plate being further formed with an access hole to permit extension of said inlet end of said spray pipe into said bidet housing for coupling with said water outlet pipe.

3. The bidet attachment as claimed in claim 1, further comprising a drive unit mounted on said base plate and coupled to said inlet end of said spray pipe, said drive unit being actuatable so as to move said spray pipe between the retracted and extended positions.

4. The bidet attachment as claimed in claim 3, further comprising a controller connected to said water supply valve, said heating element and said drive unit, said controller being operable so as to actuate said water supply valve, said heating element and said drive unit.

5. The bidet attachment as claimed in claim 4, further comprising inlet and outlet temperature sensors connected to said controller and mounted respectively on said first and second water coupling units to detect temperature of water therein, said controller being operable to adjust electrical power to said heating element to obtain a desired water temperature at said nozzle assembly.

6. The bidet attachment as claimed in claim 5, further comprising a remote control device for controlling operation of said controller.

* * * * *